US006811469B2

(12) United States Patent
Yamamoto et al.

(10) Patent No.: US 6,811,469 B2
(45) Date of Patent: Nov. 2, 2004

(54) GRINDING WHEEL FOR POLISHING AND POLISHING METHOD EMPLOYING IT

(75) Inventors: Hisao Yamamoto, Hyogo (JP); Fumiaki Saito, Hyogo (JP)

(73) Assignee: Asahi Glass Company, Limited, Tokyo (JP)

( * ) Notice: Subject to any disclaimer, the term of this patent is extended or adjusted under 35 U.S.C. 154(b) by 106 days.

(21) Appl. No.: 10/128,258

(22) Filed: Apr. 24, 2002

(65) Prior Publication Data

US 2002/0182983 A1 Dec. 5, 2002

(30) Foreign Application Priority Data

Apr. 25, 2001 (JP) ..... 2001-127978

(51) Int. Cl.[7] ..... B24B 1/00; B24D 11/00

(52) U.S. Cl. ..... 451/41; 451/44; 451/59; 451/466; 451/526

(58) Field of Search ..... 451/41, 44, 59, 451/526, 532, 536, 464, 465, 466; 15/179, 180, 187, 198

(56) References Cited

U.S. PATENT DOCUMENTS

| | | | | |
|---|---|---|---|---|
| RE31,745 | E | * 11/1984 | Pichelman | 451/532 |
| 4,561,214 | A | 12/1985 | Inoue | |
| 5,903,951 | A | 5/1999 | Ionta et al. | |
| 6,015,334 | A | 1/2000 | Hundebol | |
| 6,190,769 | B1 | 2/2001 | Wang | |
| 6,312,323 | B1 | * 11/2001 | Warner et al. | 451/532 |
| 6,319,100 | B1 | * 11/2001 | Denda et al. | 451/65 |

FOREIGN PATENT DOCUMENTS

| | | | |
|---|---|---|---|
| JP | 11126755 A | * | 5/1999 |
| JP | 2000-119079 | | 4/2000 |
| JP | 2000-124143 | | 4/2000 |
| JP | 02000263447 A | * | 9/2000 |

* cited by examiner

*Primary Examiner*—Timothy V. Eley
(74) *Attorney, Agent, or Firm*—Oblon, Spivak, McClelland, Maier & Neustadt, P.C.

(57) ABSTRACT

A grinding wheel for polishing, which comprises a grinding substrate and diamond-containing resin fibers implanted in the substrate in a form of a brush.

17 Claims, 5 Drawing Sheets

GRINDING WHEEL FOR POLISHING AND POLISHING METHOD EMPLOYING IT

The present invention relates to a grinding wheel which is most suitable for polishing of the surface of a complicated shape part of an object to be polished having a complicated shape, as typified by a groove part of a wafer boat, and a polishing method employing it.

For a heat treatment jig for production of a semiconductor as typified by a wafer boat, prevention of slip of a wafer at the time of heat treatment has been an important subject for study. Here, slip (also called "glide" or "dislocation") means formation of minute difference of elevation on a wafer due to crystal defects which can be observed by a microscope. Such a slip is considered to occur due to internal stress by the wafer's own weight or due to heat strain stress based on non-uniformity in the in-plane temperature of the wafer, since it is likely to occur at a part in the vicinity of a part of the wafer which is in contact with the jig, when the wafer is subjected to a heat treatment at a high temperature at a level of 1,000° C. for a long period of time for example.

As a countermeasure to prevent occurrence of the slip (hereinafter referred to as slip countermeasure), JP-A-2000-119079 proposes to make the surface roughness Ra at most 0.2 μm at a part on a heat treatment component for a semiconductor made of Si—SiC to be in contact with a Si wafer, and use of a diamond blade as a process therefor also as grooving. However, in the above publication, no specific disclosure is made such as the type of the diamond blade or grooving conditions.

Further, JP-A-2000-124143 proposes to make the vertical distance between the top and the root (corresponding to the surface roughness Ry) on the surface of holding grooves of a boat for heat treatment at most 10 μm, however, no specific means is disclosed.

Further, for a heat treatment jig for production of a semiconductor, in addition to the above slip countermeasure, a countermeasure for high purification is also important. For such a countermeasure for high purification, a chemical vapor deposition method (hereinafter referred to as CVD) may be carried out to form a film (hereinafter referred to as CVD film) on the surface of a substrate of the jig, since 1) such a film is excellent in heat resistance and corrosion resistance, 2) it has an extremely low content of metal impurities, 3) it can suppress diffusion of impurities such as metals in the inside of the substrate into a semiconductor wafer, and 4) it has excellent properties such as denseness.

With respect to such a CVD film, protrusions may form on the surface of the CVD film in some cases although the size and the number vary depending upon synthesis conditions. The protrusions formed on the surface of the CVD film are considered to be a main cause of the slip, and for the slip countermeasure, a method of smoothing the surface of the CVD film to eliminate the protrusions (hereinafter smoothing of the surface is generically referred to as polishing) has been desired.

In a case where the CVD film is formed on a flat plate, polishing is relatively easily carried out. However, no means has been known to polish the surface of a CVD film formed on an object to be polished having a complicated shape such as a groove part of a wafer boat. For example, when a conventional diamond blade is employed as a means of polishing a CVD film formed on a groove part of a wafer boat, a stress is applied to teeth of a comb constituting grooves in a step of applying the blade to the grooves, whereby cracks are likely to form in the vicinity of roots of the teeth of the comb, and if the film thickness is at most 150 μm, the thin CVD film is likely to be peeled off and no desired film thickness may be obtained.

Under these circumstances, it is an object of the present invention to provide a grinding wheel for polishing, which is suitable for polishing the surface of a complicated shape part of an object to be polished having a complicated shape, as typified by a groove part of a wafer boat, and a polishing method employing it.

The present invention provides a grinding wheel for polishing, which comprises a grinding substrate and diamond-containing resin fibers implanted in the substrate in a form of a brush, and a polishing method employing it.

Now, the present invention will be described in detail with reference to the preferred embodiments.

In the accompanying drawings:

FIG. 1(*a*) is a schematic plan view illustrating a grinding wheel 10 of the present invention comprising a grinding substrate 11 and fibers 12 directly implanted in one side of the substrate in a bundle.

FIG. 1(*b*) is an A—A cross section of FIG. 1(*a*).

FIG. 2(*a*) is a schematic plan view illustrating a grinding wheel 20 of the present invention comprising a grinding substrate 21 and brushes 28 fixed to the side face of the substrate, each brush 28 obtained by implanting fibers 22 in a wire 27.

FIG. 2(*b*) is a cross section of FIG. 2(*a*).

FIG. 3 is a diagram illustrating a grinding wheel 30 of the present invention comprising a grinding substrate 31 and brushes 38 similar to those in FIG. 2 fixed on the side face and grooves of the substrate.

FIG. 4(*b*) is a B—B cross section of FIG. 4(*a*).

The grinding wheel for polishing of the present invention (hereinafter referred to as the present polishing wheel) is characterized by that diamond-containing resin fibers (hereinafter referred to simply as fibers) are implanted in a polishing substrate in a form of a brush. For the present grinding wheel, as a material of the grinding substrate, various ones may be used, and a metal is preferred since it is excellent in mechanical strength, and stainless, aluminum or steel stock may, for example, be mentioned.

For implantation, the fibers may directly be implanted in one side, both sides or side face of the disk in a form of a brush, or the fibers may be indirectly implanted in such a manner that brushes (in such a shape that fibers are fixed to an entangled wire such as a brush part of a test tube brush for example) are constituted by the fibers, which are further fixed to the grinding substrate by means of e.g. bonding. Fixation of the fibers to the grinding substrate is not particularly limited, and adhesion, welding, soldering or fastening by a wire may, for example, be mentioned. Here, in the present specification, implantation in a form of a brush means that the fibers are densely implanted.

Figure 1:
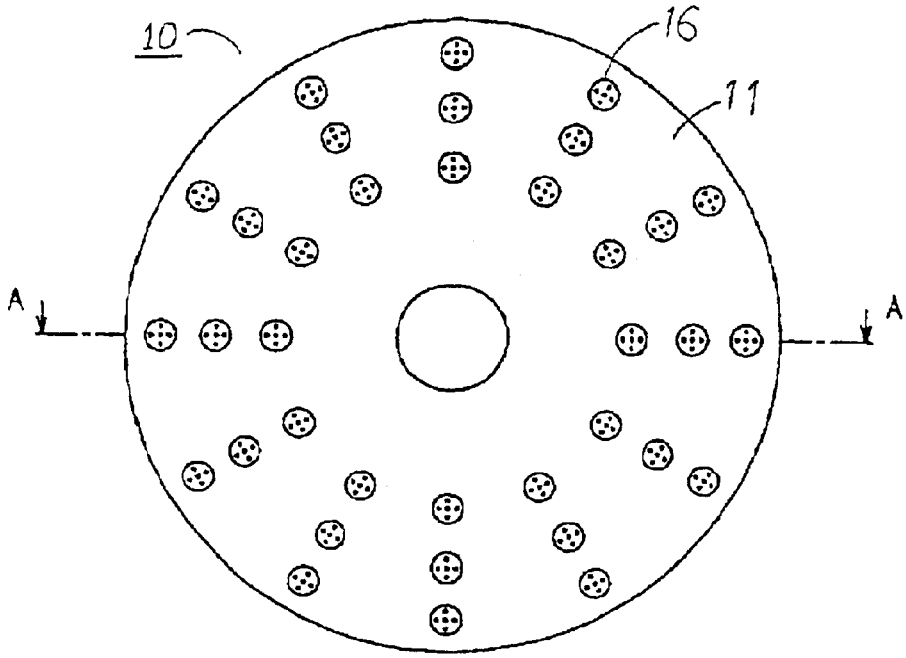
Figure 1:
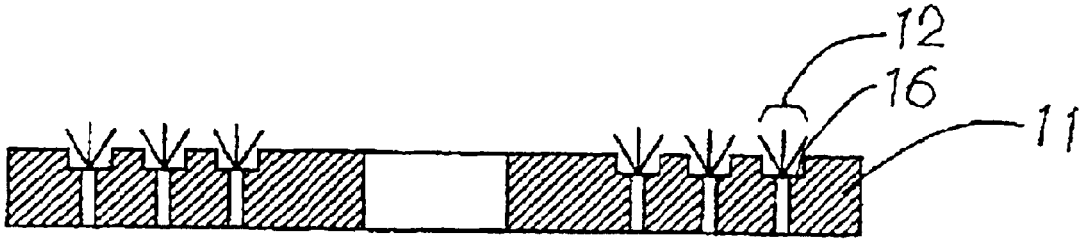

In a case of directly implanting the fibers, each fiber may be implanted with a short interval. Otherwise, it is possible to obtain the present grinding wheel 10 by forming a large number of small holes 16 on a discal grinding substrate 11, and putting and implanting a plurality of fibers 12 in the small pores 16 in a bundle, as illustrated in FIGS. 1(*a*) and 1(*b*). The number of the fibers 12 in a bundle is preferably at a level of from 2 to 100, more preferably at a level of from 5 to 50, particularly preferably from 10 to 30. If the number of the fibers 12 in a bundle is too large, rigidity tends to be high, and there is fear that scars may form due to polishing.

The interval between bundles (hereinafter referred to as pitch) is optionally selected depending upon the number of the fibers in a bundle. In a case of FIG. 1(*a*), the pitch is the minimum distance between two adjacent small holes 16. When the number of the fibers in a bundle is large, the pitch is increased, and when the number of the fibers in a bundle is small, the pitch is reduced. If the pitch is small, the load during polishing tends to be heavy, and accordingly the pitch is preferably at least 5 mm, more preferably from 5 to 20 mm. The pitch may be constant in the present grinding wheel, or the pitch in a radius direction may be different from that in a circle direction.

Here, as a fixation method of the fibers 12 in a bundle, the fibers 12 may directly be bonded to the grinding substrate 11 by an adhesive for implantation, or the fibers 12 may be bent at least double, hitched on a wire, and fastened and fixed with the wire for implantation. FIGS. 1(*a*) and 1(*b*) illustrate an example wherein fibers 12 are fixed by a wire which is not shown. It is also possible that the fibers 12 in a bundle are fastened by a metal ring, which are pressed into small holes 16 on a grinding substrate 11, or the metal ring is fixed by e.g. welding.

Figure 2:
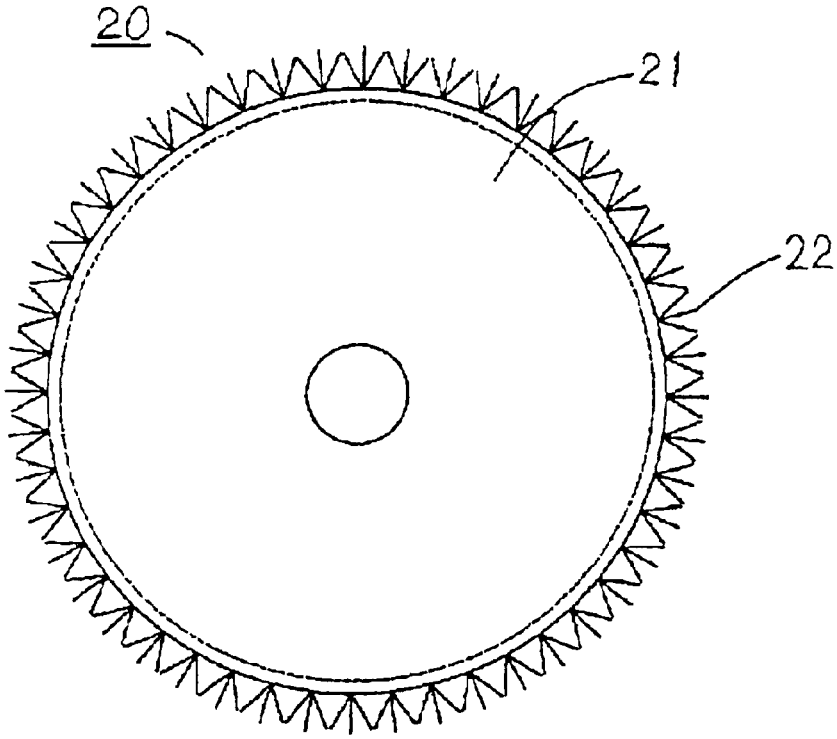
Figure 2:
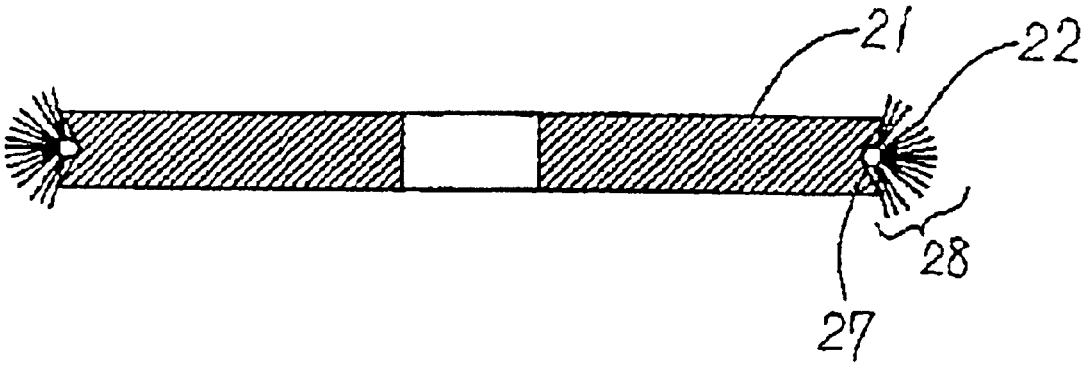
Figure 3:
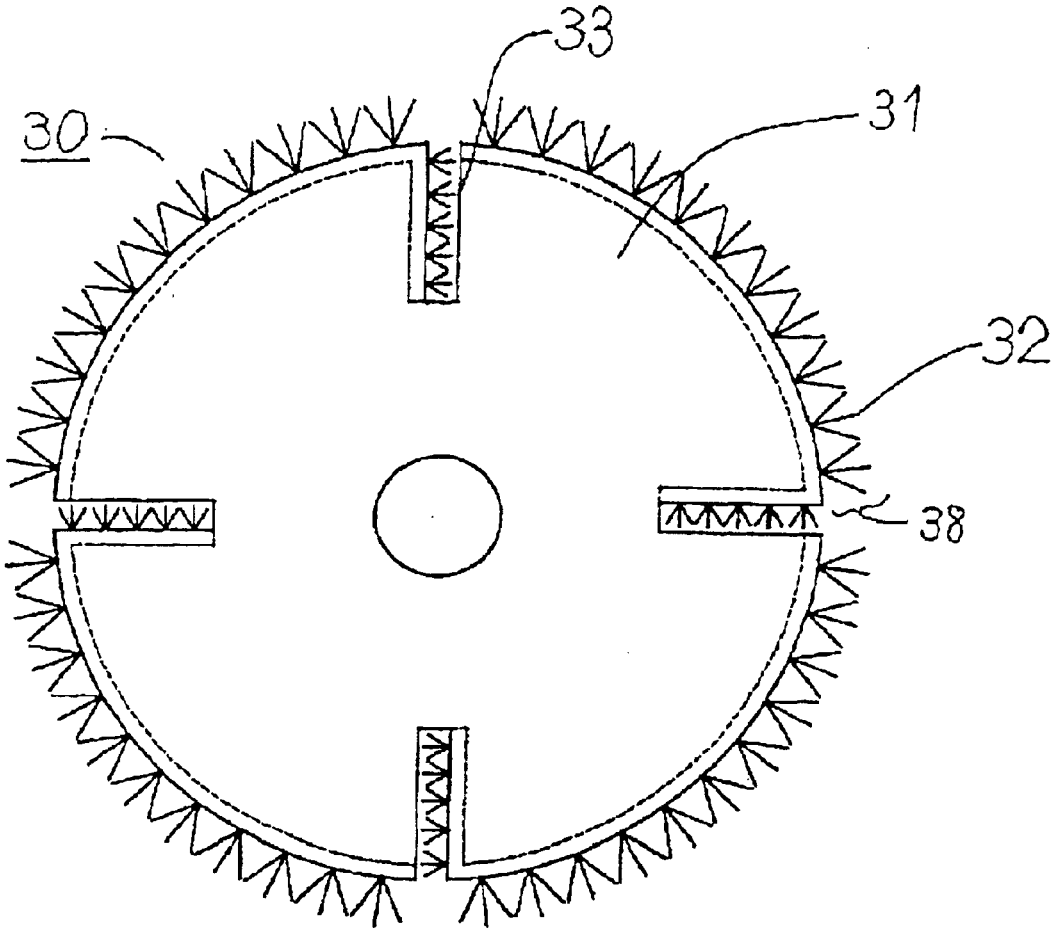

FIGS. 2(*a*) and 2(*b*) illustrate an example wherein fibers 22 are implanted in a wire 27 to obtain a brush 28, and a plurality thereof is bonded to the side face of a grinding substrate 21 to obtain a grinding wheel 20 of the present invention. FIG. 3 illustrates an example wherein brushes 38 similar to those in FIG. 2(*b*), comprising fibers 32, are fixed to grooves 33 formed on a grinding substrate 31 in addition to the side face of the grinding substrate 31 to obtain a grinding wheel 30 of the present invention.

Figure 4:
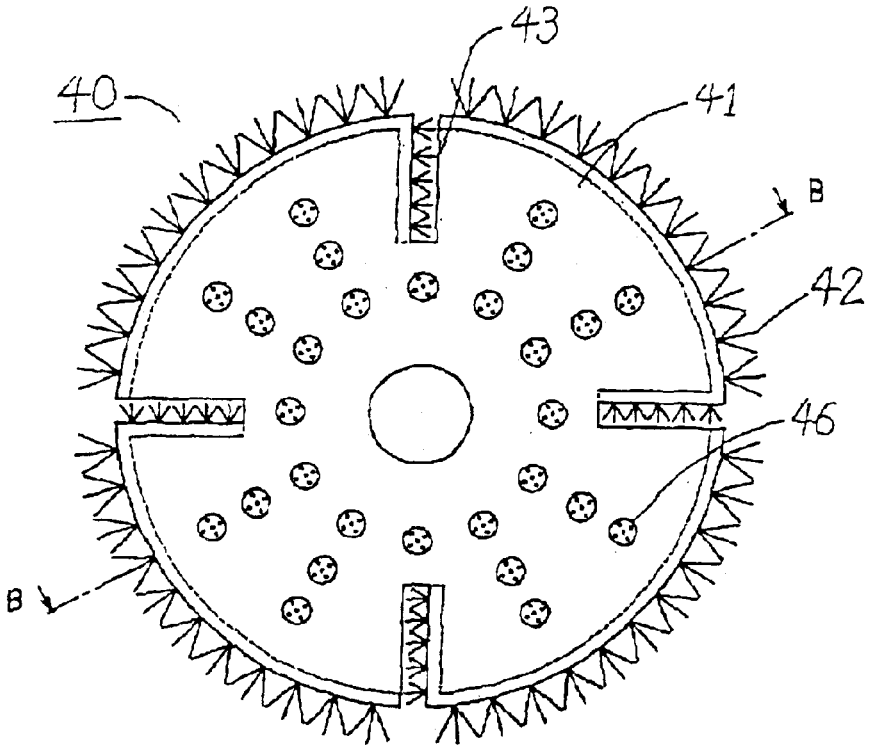
FIG. 4(*a*) is a schematic plan view illustrating a grinding wheel 40 of the present invention comprising the construction of FIGS. 1(*a*) and 1(*b*) and the construction of FIG. 3 combined.
Figure 4:
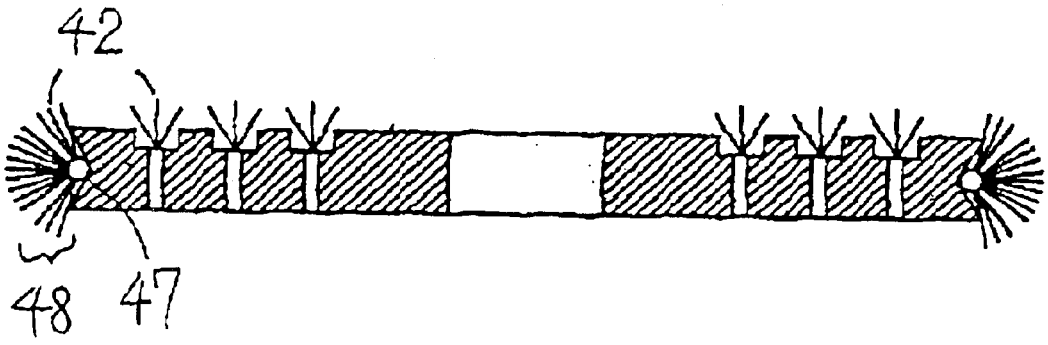
Figure 5:
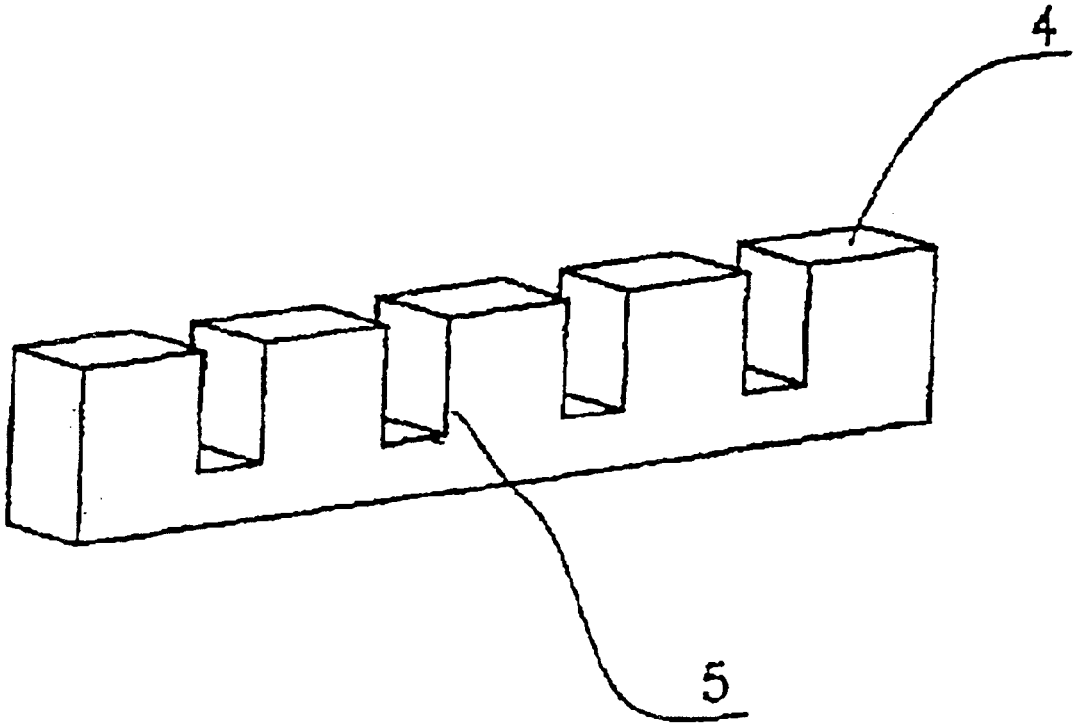
FIG. 5 is a schematic view illustrating a sample having grooves used in Examples.

FIGS. 4(*a*) and 4(*b*) illustrate an example wherein small holes 46 are formed on the flat surface of a grinding substrate 41 having grooves 43 formed thereon, and fibers 42 are fixed in the same construction as illustrated in FIGS. 1(*a*) and 1(*b*), and brushes 48 similar to those in FIG. 2(*b*), obtained by implanting fibers 42 in a wire 47, are fixed to the side face in the same construction as illustrated in FIG. 3, and both constructions are combined to obtain a grinding wheel 40 of the present invention.

In the present invention, the type of the resin of the fibers is not particularly limited, and a nylon resin may, for example, be mentioned in view of the balance between the hardness and elasticity. The diameter of the fibers is not particularly limited also, but fibers having a diameter of from 0.1 to 1.5 mm are preferred since they are readily available. The diameter of the fibers is more preferably from 0.1 to 1.0 mm, particularly preferably from 0.1 to 0.4 mm.

The length of the fibers is not particularly limited also, but fibers having a length of from 0.5 to 10 mm are preferred since they are readily available. The length of the fibers is more preferably from 1 to 6 mm in view of e.g. processability. It is more preferred that the diameter of the fibers is from 0.1 to 0.4 mm, and the length of the fibers is from 1 to 6 mm.

The ratio of (the length of the fibers)/(the diameter of the fibers) is particularly preferably from 10 to 30, whereby the degree of polishing and the surface state can readily be controlled. As an example of a preferred fiber shape, fibers having a length of 3 mm and a diameter of 0.15 mm may be mentioned.

In the present invention, the particle size of the diamond is optionally selected depending upon the required surface roughness, and it is preferably from #400 to #3,000 as stipulated in JIS R6001 (electric resistance test). If the particle size of the diamond is rougher than #400, scars are likely to form on the polished surface, and further, if the particle size of the diamond is finer than #3,000, the surface roughness to be obtained is less likely to be lessened any more, and it tends to be difficult to prepare the grinding wheel.

In the present invention, the particle size of the diamond is preferably such that the particle diameter is from 4 to 30 $\mu$m at a 50% point of the cumulative height (electric resistance test). If the above particle diameter is larger than 30 $\mu$m, scars are likely to form on the polished surface, and if the particle diameter is smaller than 4 $\mu$m, the surface roughness to be obtained is less likely to be lessened any more, and it tends to be difficult to prepare the grinding wheel.

Further, the particle size of the diamond is more preferably such that the particle diameter is from 4 to 14 $\mu$m at a 50% point of the cumulative height, whereby an edge part of teeth forming grooves of an object to be polished such as a wafer boat, can be polished without impairing accuracy of form, while chamfering the edge part into a curved shape with a curvature radius of from 0.2 to 3 mm (hereinafter referred to as R-chamfering).

In the present invention, the content of the diamond contained in the fibers is preferably from 5 to 40 mass % in the fibers. Here, the type of the diamond is not particularly limited, and synthetic diamond or natural diamond may optionally be used.

As an object to be polished by using the present grinding wheel, a surface for which mirror polishing is required may be mentioned. It is suitable to polish the surface of a complicated shape part of an object to be polished having a complicated shape by using the present grinding wheel. For example, in a case where the surface to be polished is the surface of a groove part of a wafer boat, said groove part is weak in mechanical strength and has a complicated shape, and accordingly it is preferably polished by the present grinding wheel.

Further, it is particularly preferred to polish the surface of a complicated shape part of an object to be polished having a complicated shape, on which a vapor deposition film by CVD or a vapor deposition film by PVD is formed, by the present grinding wheel, whereby effects of use of the present grinding wheel can be obtained. The surface of a groove part of a SiC wafer boat, the surface of which is covered with a SiC film formed by CVD, may, for example, be mentioned.

The surface roughness on the surface polished by the present grinding wheel can be controlled by selecting the particle size of the diamond. The surface roughness Ry on the surface to be in contact with e.g. a wafer is particularly preferably at most 5 $\mu$m, whereby excellent smoothness tends to be obtained, and the surface roughness Ry is more preferably at most 2 $\mu$m. It is particularly preferred as a slip countermeasure of a wafer that the surface roughness Ry is at most 1 $\mu$m and the surface roughness Ra is at most 0.1 $\mu$m.

In a case where the vapor deposition film surface is polished by using the present grinding wheel, the thickness of the vapor deposition layer after polishing is preferably at least 20 $\mu$m, whereby functions of the CVD vapor deposition film such as prevention of diffusion of impurities in the substrate are not impaired.

As conditions of polishing by using the present grinding wheel, the peripheral speed of the grinding wheel is preferably from 100 to 1,500 m/min, more preferably from 300 to 800 m/min, the feed rate of the grinding wheel is preferably from 0.5 to 20 mm/min, more preferably from 3 to 10 mm/min, and the depth of cut by the grinding wheel is preferably from 0.1 to 5 mm, whereby the surface roughness Ry on the polished surface of at most 1 μm is likely to be obtained.

Now, the present invention will be described in further detail with reference to Examples. However, it should be understood that the present invention is by no means restricted to such specific Examples.

As samples 4 for evaluation (hereinafter referred to simply as samples), a plurality of blocks (30×12×100 mm) made of silicon-impregnated SiC having four grooves (20×12×10 mm) formed thereon with an interval of 10 mm, were prepared. Some of the blocks were put in a CVD apparatus to form a CVD film of SiC on their surface. The thickness of the CVD film was 60 μm as calculated from the change in dimension. Further, as the surface state on the CVD film surface, the surface roughness Ra was 1.5 μm and the surface roughness Ry was 15 μm.

EXAMPLE 1

On a grinding substrate 11 made of an aluminum disk having a diameter of 200 mm and a thickness of 3 mm, small holes 16 having a diameter of 2.5 mm were formed as illustrated in FIGS. 1(*a*) and 1(*b*), and ten fibers 12 made of a nylon resin having a diameter of 0.15 mm and a length of 3 mm (particle size of diamond contained: particle diameter of 6.7 μm at a 50% point of the cumulative height, diamond content: 25 mass %) were implanted in a bundle in each of the small holes to prepare a grinding wheel 10 of the present invention. Here, the fibers 12 were fixed by a wire made of a metal (not shown) so that the length of the fibers which protruded from the aluminum disk 11 become about 2 mm. Further, the interval between the small hole 16 and the small hole 16 was about 10 mm.

Using teeth 5 of a comb constituting grooves of the sample 4 having a CVD film of SiC formed thereon (hereinafter referred to simply as teeth of a comb), wet polishing (depth of cut: 1 mm) was conducted three times under each of conditions as identified in Table 1, and the surface state after the polishing (surface roughness the surface roughness Ry) was measured by means of a surface roughness meter (manufactured by Tokyo Seimitsu Co., Ltd., trade name: SURFCOM). Further, a part in the vicinity of roots of the teeth 5 of the comb after the polishing was visually observed, and absence of defects such as cracks was confirmed.

TABLE 1

| Conditions | Peripheral speed (m/min) | Feed rate (mm/min) | Surface roughness Ra (μm) | Surface roughness Ry (μm) |
|---|---|---|---|---|
| 1 | 400 | 6 | 0.1 | 0.5 |
| 2 | 600 | 6 | 0.1 | 0.6 |
| 3 | 900 | 9 | 0.3 | 1.5 |
| 4 | 900 | 15 | 0.3 | 1.6 |
| 5 | 700 | 6 | 0.1 | 0.5 |
| 6 | 700 | 9 | 0.1 | 0.6 |
| 7 | 1100 | 15 | 0.5 | 4.0 |

EXAMPLE 2

The same operation as in Example 1 was carried out that a sample 4 having no CVD film of SiC formed thereon (surface state on the groove surface: surface roughness Ra 0.3 μm, surface roughness Ry 3 μm) was used instead of the sample 4 having a CVD film of SiC formed thereon. The polishing was conducted under condition 2 in Table 1. The surface state of the teeth 5 of the comb after the polishing was measured in the same manner as in Example 1, and Ra was 0.1 μm and Ry was 1 μm.

EXAMPLE 3

As a grinding wheel 30 of the present invention, as illustrated in FIG. 3, a grinding wheel was prepared in such a manner that on a grinding substrate 31 made of an aluminum disk having a diameter of 200 mm and a thickness of 2 mm, four grooves 33 having a width of 5 mm and a length of 70 mm in a radius direction were formed, and brushes 38 having an outer diameter of about 5.5 mm, obtained by implanting a large number of fibers 32 made of a nylon resin having a diameter of 0.2 mm and a length of 2 mm (particle size of diamond contained: particle diameter of 6.7 μm at a 50% point of the cumulative height, diamond content: 25 mass %) in a wire (not shown) made of stainless having a diameter of 0.7 mm, were bonded to the side face including the grooves.

Using this grinding wheel, the teeth 5 of the comb of the sample 4 having a CVD film formed thereon was polished by a wet method under condition 1 of Table 1. The surface state of the teeth 5 of the comb polished was measured in the same manner as in Example 1, and Ra was 0.3 μm and Ry was 1.5 μm.

EXAMPLE 4

The same operation as in Example 1 was carried out except that the particle size of diamond contained in the nylon resin fibers 12 was such that the particle diameter was 11.5 μm at a 50% point of the cumulative height. The polishing was conducted under condition 2 of Table 1. The surface state of the polished surface was measured in the same manner as in Example 1, and Ra was 0.2 μm and Ry was 1.5 μm.

EXAMPLE 5

Comparative Example

In Example 4, polishing was carried out by using a diamond grinding wheel comprising a grinding substrate and diamond abrasive grains bonded to the substrate by means of a resin bond (particle diameter at a 50% point of the cumulative height: 11.5 μm) instead of the grinding wheel 10 of the present invention. The polishing was conducted under condition 2 of Table 1. The surface state of the polished surface was observed, and it was confirmed that part of the CVD film was peeled off. Further, a part in the vicinity of roots of the teeth 5 of the comb was observed, and it was confirmed that fine cracks were formed on some part. Such results indicate that polishing while leveling a complicated shape part such as grooves is difficult with a conventional grinding wheel.

EXAMPLE 6

The same operation as in Example 2 was carried out except that fibers having a diameter of 0.6 mm and a length of 3 mm (particle size of diamond contained: particle diameter of 30 μm at a 50% point of the cumulative height, diamond content: 35 mass %) were used instead of the fibers 12 made of a nylon resin having a diameter of 0.15 mm and a length of 3 mm (particle size of diamond contained: particle diameter of 6.7 μm at a 50% point of the cumulative height, diamond content: 25 mass %) and that the edge part of the teeth 5 of the comb was subjected to automatic polishing. As a result, it was confirmed that automatic polishing to let the edge part be R-chamfered with a curvature radius of about 1 mm could be conducted without impairing the accuracy of form of the grooves.

EXAMPLE 7

The same operation as in Example 6 was carried out except that fibers having a diameter of 1 mm and a length of 3 mm (particle size of diamond contained: particle diameter of 14 μm at a 50% point of the cumulative height, diamond content: 30 mass %) were used instead of the fibers 12 made of a nylon resin having a diameter of 0.6 mm and a length of 3 mm (particle size of diamond contained: particle diameter of 30 μm at a 50% point of the cumulative height, diamond content: 35 mass %). As a result, it was confirmed that automatic polishing to let the edge part be R-chamfered with a curvature radius of about 1 mm could be conducted without impairing the accuracy of form of the grooves in the same manner as in Example 6.

EXAMPLE 8

The same operation as in Example 6 was carried out except that fibers having a diameter of 1 mm and a length of 3 mm (particle size of diamond contained: particle diameter of 57 μm at a 50% point of the cumulative height, diamond content: 35 mass %) were used instead of the fibers 12 made of a nylon resin having a diameter of 0.6 mm and a length of 3 mm (particle size of diamond contained: particle diameter of 30 μm at a 50% point of the cumulative height, diamond content: 35 mass %). As a result, it was confirmed that automatic polishing to let the edge part be R-chamfered with a curvature radius of about 1 mm could be carried out in the same manner as in Example 6, however, the accuracy of form of the grooves was slightly poor as compared with Example 6.

According to the present grinding wheel, the surface of an object to be polished having a complicated shape can be polished into a mirror surface while leveling the surface. For example, the surface of an object to be polished having low mechanical strength and a complicated shape, such as a groove part of a wafer boat, can be polished into a mirror surface. Further, since the load during polishing tends to be low, the polished surface is less likely to be damaged. Further, the polishing method using the present grinding wheel is a leveling processing, whereby the polishing cost tends to be low, and the surface can be polished into a mirror surface while maintaining the accuracy of form, such being advantageous.

Further, by using the present grinding wheel, R-chamfering of the edge part of teeth forming grooves with a curvature radius of from 0.2 to 3 mm can be conducted by automatic polishing with a good accuracy.

Even when the surface to be polished has a CVD vapor deposition film formed thereon, it can be polished without being damaged at a low polishing cost, whereby it can be polished into a mirror surface while securing the CVD film thickness. In such a case, protrusions which are characteristic to the CVD vapor deposition film can be eliminated, whereby particularly the surface roughness Ry can be lessened. Accordingly, use of a wafer boat polished by the present grinding wheel is particularly effective for the slip countermeasure.

The entire disclosure of Japanese Patent Application No. 2001-127978 filed on Apr. 25, 2001 including specification, claims, drawings and summary are incorporated herein by reference in its entirety.

What is claimed is:

1. A polishing method comprising polishing a surface with a grinding wheel comprising a grinding substrate and diamond-containing resin fibers implanted in the substrate in a form of a brush, wherein the particle size of the diamond is such that the particle diameter is from 4 to 30 μm at a 50% point of the cumulative height.

2. The polishing method according to claim 1, wherein at least some of the diamond-containing resin fibers are implanted in a bundle.

3. The polishing method according to claim 1, wherein the resin fibers are made of a nylon resin, and the nylon resin fibers have a diameter of from 0.1 to 1.5 mm.

4. The polishing method according to claim 3, wherein the nylon resin fibers have a length of from 0.5 to 10 mm.

5. The polishing method according to claim 1, wherein the surface roughness Ry on a polished surface is made to be at most 5 μm.

6. A method of polishing a wafer boat, which comprises polishing a groove part of the wafer boat by the polishing method as defined in claim 5.

7. The method according to claim 1, wherein the surface being polished comprises a surface film formed by chemical vapor deposition (CVD) or physical vapor deposition (PVD).

8. A method of polishing a wafer boat, which comprises polishing a groove part of a wafer boat by polishing said groove part with a grinding wheel comprising a grinding substrate and diamond-containing resin fibers implanted in said substrate in a form of a brush and R-chamfering an edge part of teeth forming the groove part of the wafer boat with a curvature radius of from 0.2 to 3 mm.

9. A grinding wheel for polishing, which comprises a grinding substrate and diamond-containing resin fibers implanted in the substrate in a form of a brush, wherein the particle size of the diamond is such that the particle diameter is from 4 to 30 μm at a 50% point of the cumulative height.

10. The grinding wheel for polishing according to claim 9, wherein at least some of the diamond-containing resin fibers are implanted in a bundle.

11. The grinding wheel for polishing according to claim 9, wherein the resin fibers are made of a nylon resin, and the nylon resin fibers have a diameter of from 0.1 to 1.5 mm.

12. The grinding wheel for polishing according to claim 11, wherein the nylon resin fibers have a length of from 0.5 to 10 mm.

13. The grinding wheel for polishing according to claim 11, wherein the nylon resin fibers have a length of from 1 to 6 mm.

14. The grinding wheel for polishing according to claim 9, wherein the resin fibers are made of a nylon resin, and the nylon resin fibers have a diameter of from 0.1 to 1 mm.

15. The grinding wheel for polishing according to claim 14, wherein the nylon resin fibers have a length of from 0.5 to 10 mm.

16. The grinding wheel for polishing according to claim 9, wherein the resin fibers are made of a nylon resin, and the nylon resin fibers have a diameter of from 0.1 to 0.4 mm.

17. The grinding wheel for polishing according to claim 16, wherein the nylon resin fibers have a length of from 0.5 to 10 mm.

* * * * *